US011253981B2

(12) United States Patent
Chan

(10) Patent No.: US 11,253,981 B2
(45) Date of Patent: Feb. 22, 2022

(54) RATCHET WRENCH

(71) Applicant: Stanley Chiro International Ltd., Taichung (TW)

(72) Inventor: Yi-Tung Chan, Taichung (TW)

(73) Assignee: STANLEY CHIRO INTERNATIONAL LTD., Taichung (TW)

( * ) Notice: Subject to any disclaimer, the term of this patent is extended or adjusted under 35 U.S.C. 154(b) by 499 days.

(21) Appl. No.: 16/304,001

(22) PCT Filed: May 26, 2017

(86) PCT No.: PCT/CN2017/086031

§ 371 (c)(1),
(2) Date: Nov. 21, 2018

(87) PCT Pub. No.: WO2018/001012

PCT Pub. Date: Jan. 4, 2018

(65) Prior Publication Data

US 2019/0176299 A1 Jun. 13, 2019

(30) Foreign Application Priority Data

Jun. 29, 2016 (CN) ..... 201610495229.6

(51) Int. Cl.
*B25B 13/46* (2006.01)
*B25B 23/00* (2006.01)

(52) U.S. Cl.
CPC ..... *B25B 13/463* (2013.01); *B25B 13/46* (2013.01); *B25B 23/0007* (2013.01)

(58) Field of Classification Search
None
See application file for complete search history.

(56) References Cited

U.S. PATENT DOCUMENTS 7,121,170 B2 * 10/2006 Shen ..... B25B 13/463 81/63.2
8,631,723 B2 * 1/2014 Chang ..... B25B 13/463 81/63

(Continued)

FOREIGN PATENT DOCUMENTS

CN 2892384 Y 4/2007
CN 201394802 Y 2/2010

(Continued)

*Primary Examiner* — Brian D Keller
(74) *Attorney, Agent, or Firm* — Muncy, Geissler, Olds & Lowe, P.C.

(57) ABSTRACT

A ratchet wrench is provided, including a main body, a driving member, a restricting member, a switching member and an elastic abutting assembly. The main body has a first receiving, chamber, a second receiving chamber and a third receiving chamber which is communicated with the first receiving chamber and the second receiving chamber. One end of the second receiving chamber is formed with a larger diameter section, and the other end of the second receiving chamber is formed with a small diameter section. The driving member is rotatably assembled within the receiving chamber. The restricting member is disposed in the third receiving chamber and limitable to a rotational direction of the driving member. The switching member is rotatably disposed within the second receiving chamber and includes a rotatable member and a projection which extends from the rotatable member. The rotatable member is received in the larger diameter section and the projection is received in the small diameter section. A bottom of the ratchet wrench of this invention is smoothly rotatable and the ratchet wrench effectively prevents the bottom from departing from the main body, which increase durability and efficiency.

7 Claims, 5 Drawing Sheets

(56) References Cited

U.S. PATENT DOCUMENTS

| | | | | |
|---|---|---|---|---|
| 8,661,933 | B2 | 3/2014 | Andersson et al. | |
| 10,335,929 | B2 * | 7/2019 | Chou | B25B 13/04 |
| 2005/0011314 | A1 * | 1/2005 | Chen | B25B 13/463 81/63 |
| 2018/0222020 | A1 * | 8/2018 | Yang | B25B 13/463 |
| 2018/0339403 | A1 * | 11/2018 | Chen | B25B 13/463 |

FOREIGN PATENT DOCUMENTS

| | | | |
|---|---|---|---|
| CN | 201394803 | Y | 2/2010 |
| CN | 105328615 | A | 2/2016 |
| TW | 422158 | U | 2/2001 |
| TW | 425953 | U | 3/2001 |
| TW | M520964 | | 5/2016 |

* cited by examiner

RATCHET WRENCH

BACKGROUND OF THE INVENTION

Field of the Invention

The present invention relates to a hand tool, and more particularly to a ratchet wrench.

Description of the Prior Art

A conventional ratchet wrench disclosed in Taiwan patent number M520964 includes a main body assembled with a driving ratchet, a ratchet block and a switch. The switch is rotatably disposed on the main body, and a spring is disposed between the switch and the ratchet block so that the ratchet block has a tendency to normally bias the driving ratchet to restrict a rotational direction of the driving ratchet.

However, the switch of the conventional ratchet wrench can sway when being switched so that the switch cannot be rotated smoothly. The switch may depart from the main body and result in breaking up into components, which influences efficiency of work.

The present invention is, therefore, arisen to obviate or at least mitigate the above-mentioned disadvantages.

SUMMARY OF THE INVENTION

The main object of the present invention is to provide a ratchet wrench which can prevent the switching member from departing from the main body, and the switching member is smoothly rotatable, which increases durability and operating efficiency of the ratchet wrench.

To achieve the above and other objects, the present invention provides following technical solutions.

A ratchet wrench is provided, including a main body, a driving member, a restricting member, a switching member and an elastic abutting assembly. The main body has a first receiving chamber, a second receiving chamber being parallel to the first receiving chamber, and a third receiving chamber which is communicated with the first receiving chamber and the second receiving chamber. One end of the second receiving chamber includes a larger diameter section, and another end of the second receiving chamber includes a small diameter section. The driving member is rotatably assembled within the first receiving chamber, and a first engaging portion is disposed around a peripheral surface of the driving member. The restricting member is disposed in the third receiving chamber and has a second engaging portion which is engageable with the first engaging portion and configured to limit a rotational direction of the driving member. The switching member is rotatably disposed within the second receiving chamber and includes a rotatable member and a projection which extends from the rotatable member. The rotatable member is received in the larger diameter section, and the projection is received in the small diameter section. An end of the rotatable member away from the projection has a turning member extending radially, and the rotatable member has a receiving hole radially recessed thereon. One end of the elastic abutting assembly is received within the receiving hole of the rotatable member, and another end of the elastic abutting assembly is restrictedly abutted against the restricting member and biases the restricting member toward the first engaging portion. Wherein a position where the restricting member and the first engaging portion engage with each other is switchable by adjusting the switching member so as to adjust the rotational direction of the driving member.

Specifically, the elastic abutting assembly includes an elastic member and an abutting block, and the elastic member is sleeved on the abutting block and received within the receiving hole.

The abutting block is E-shaped, the abutting block includes a sleeved leg and two blocking arms which are located at two sides of the sleeved leg respectively, the elastic member is sleeved on the sleeved leg, and the two blocking arms are slidably received within the receiving hole.

The receiving hole includes an enlarged portion and two extending portions between which the enlarged portion is disposed, the two blocking arms are located within the two extending portion respectively, and the elastic member and the sleeved leg are located within the enlarged portion.

An end of the restricting member away from the first engaging portion has a recession, and an end of the abutting block away from the switching member is abutted against an inner wall of the recession.

The rotatable member has a notched portion radially facing toward the restricting member, the rotatable member has a flange correspondingly above the notched portion, the notched portion includes a protruding portion and concaves located at two sides of the protruding portion, and the receiving hole is disposed at the protruding portion.

As viewed in an axial direction of the rotatable member, a diametric dimension of the flange is larger than that of the protruding portion.

A first stepped portion is formed between the larger diameter section and the small diameter section, a second stepped portion is formed between the rotatable member and the projection, and the first stepped portion and the second stepped portion are abutted against each other.

The rotatable member has a notched portion radially facing toward the restricting member, the rotatable member has a flange correspondingly above the notched portion, the notched portion includes a protruding portion and concaves located at two sides of the protruding portion, and the receiving hole is disposed at the protruding portion; as viewed in an axial direction of the rotatable member, a diametric dimension of the flange is larger than that of the protruding portion; a first stepped portion is formed between the larger diameter section and the small diameter section, a second stepped portion is formed between the rotatable member and the projection, and the first stepped portion and the second stepped portion are abutted against each other; an end of the restricting member away from the first engaging portion has a recession, an end of the abutting block away from the switching member is abutted against an inner wall of the recession.

Advantages of this invention is that, the ratchet wrench can prevent the switching member from departing from the main body, and the switching member is smoothly rotatable, which increases durability and operating efficiency of the ratchet wrench.

DETAILED DESCRIPTION OF THE PREFERRED EMBODIMENTS

Figures 1, 2:
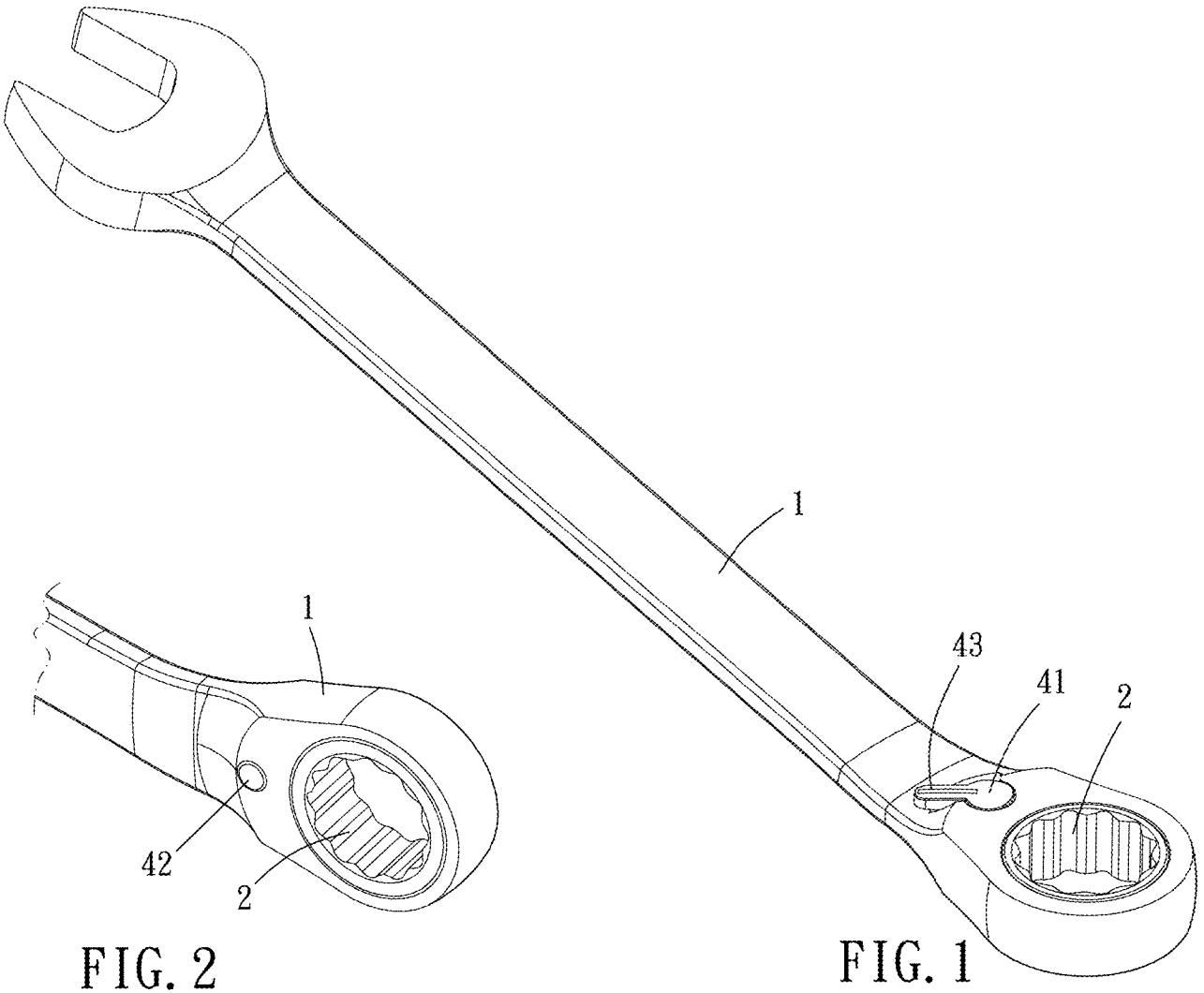
FIG. 1 is a stereogram of a preferable embodiment of the present invention.
FIG. 2 is a partial stereogram of a preferable embodiment of the present invention.
Figure 4:
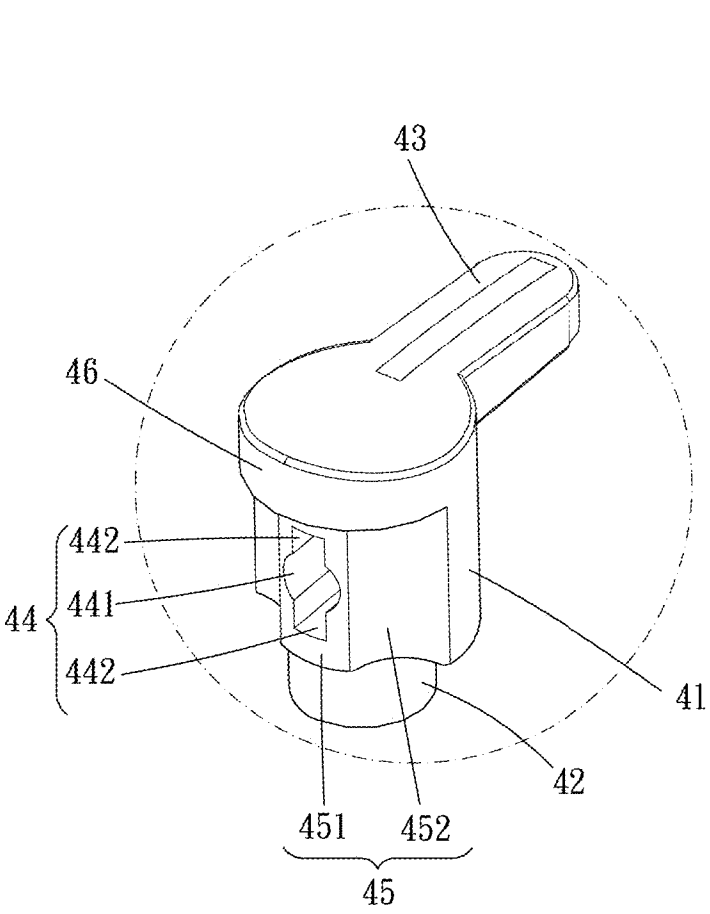
FIG. 4 is a partial enlargement of a preferable embodiment of the present invention.
Figure 3:
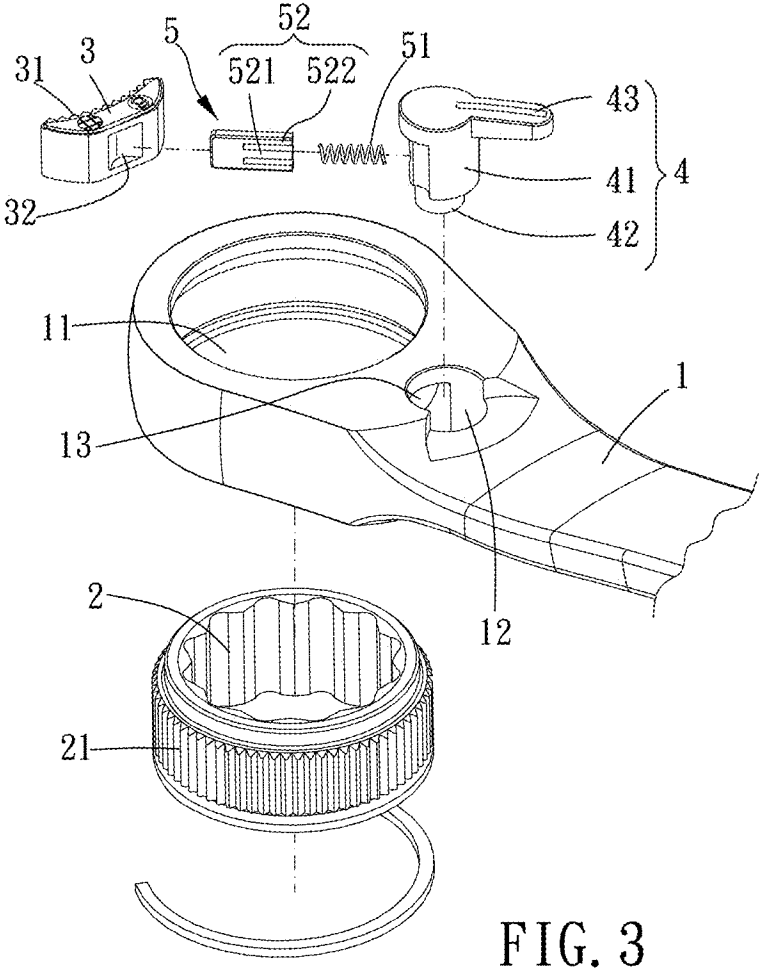
FIG. 3 is a breakdown drawing of a preferable embodiment of the present invention.
Figure 5:
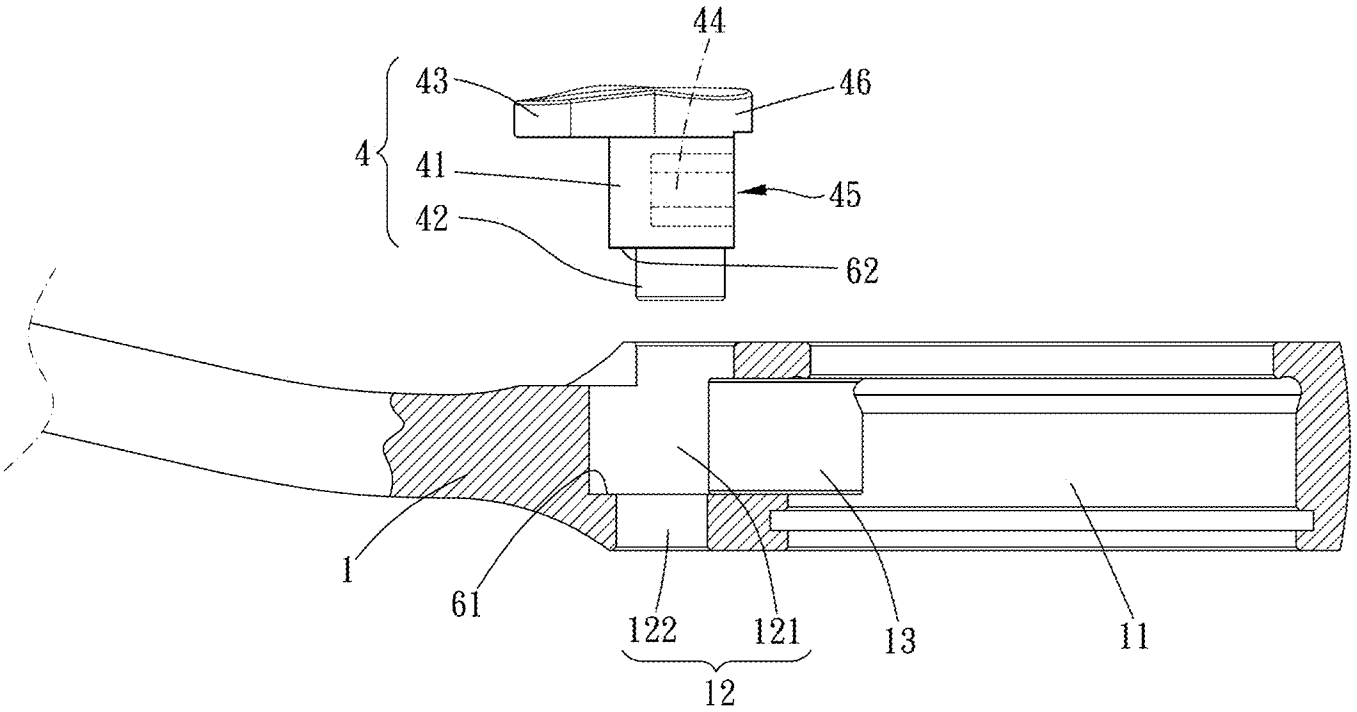
FIGS. 5 and 6 are assembly diagrams of a preferable embodiment of the present invention.
Figure 6:
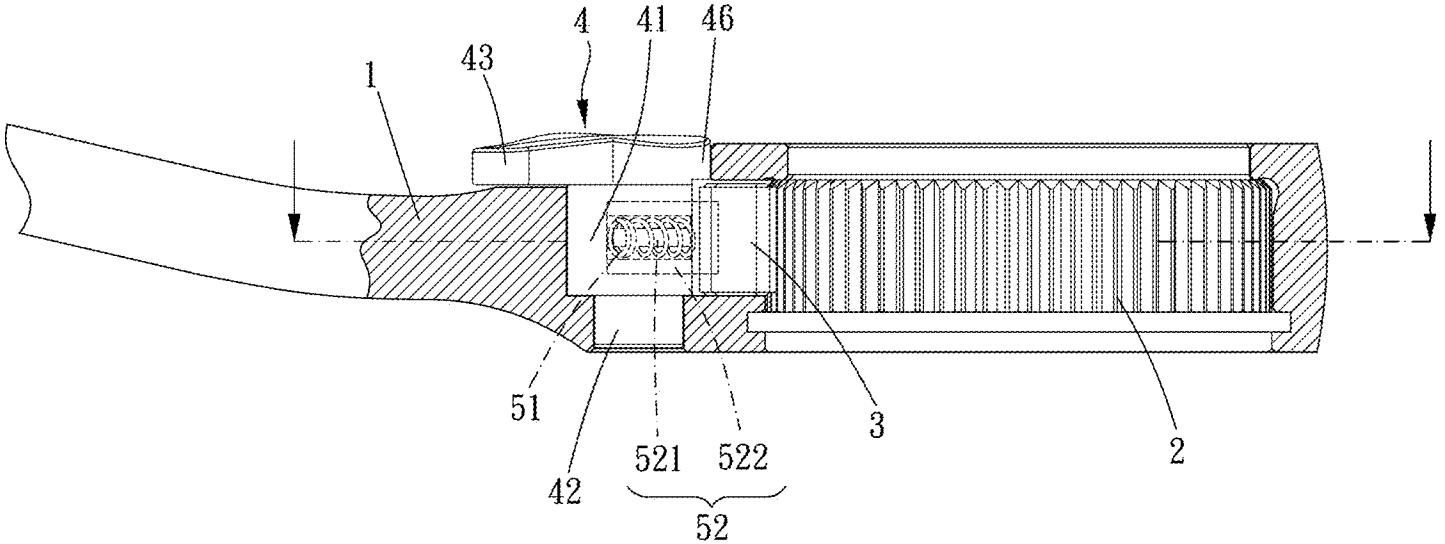

Please refer to FIGS. 1 to 6 for a preferable embodiment of the present invention. A ratchet wrench of the present invention includes a main body 1, a driving member 2, a restricting member 3, a switching member 4 and an elastic abutting assembly 5.

The main body 1 has a first receiving chamber 11, a second receiving chamber 12 being parallel to the first receiving chamber 11, and a third receiving chamber 13 which is communicated with the first receiving chamber 11 and the second receiving chamber 12. One end of the second receiving chamber 12 includes a larger diameter section 121, and another end of the second receiving chamber 12 includes a small diameter section 122.

The driving member 2 is rotatably assembled within the first receiving chamber 11, and a first engaging portion 21 is disposed around a peripheral surface of the driving member 2. In this embodiment, the first engaging portion 21 includes a plurality of teeth, and an inner circumferential surface of the driving member 2 includes an operating portion. The operating portion is a polygonal through hole. In other embodiments, the operating portion may be a polygonal protruding portion, and the operating portion is configured to be assembled with a member such as a nut or socket.

The restricting member 3 is disposed in the third receiving chamber 13 and has a second engaging portion 31 which is engageable with the first engaging portion 21 and configured to limit a rotational direction of the driving member 2. In this embodiment, a shape of the second engaging portion 31 corresponds to a shape of the first engaging portion 21, and the second engaging portion 31 and the first engaging portion 21 may include a plurality of teeth.

The switching member 4 is rotatably disposed within the second receiving chamber 12 and includes a rotatable member 41 and a projection 42 which extends from the rotatable member 41. The rotatable member 41 is received in the larger diameter section 121 and the projection 42 is received in the small diameter section 122. An end of the rotatable member 41 away from the projection 42 has a turning member 43 extending radially, and the rotatable member 41 has a receiving hole 44 radially recessed thereon so that the rotatable member 41 is smoothly rotatable about the projection 42. Preferably, a first stepped portion 61 is formed between the larger diameter section 121 and the small diameter section 122, and a second stepped portion 62 is formed between the rotatable member 41 and the projection 42. The first stepped portion 61 and the second stepped portion 62 are abutted against each other so that the rotatable member 41 may be positioned stably in the larger diameter section 121.

One end of the elastic abutting assembly 5 is received within the receiving hole 44 of the rotatable member 41, and another end of the elastic abutting assembly 5 is restrictedly abutted against the restricting member 3 and biases the restricting member 3 toward the first engaging portion 21.

Figure 8:
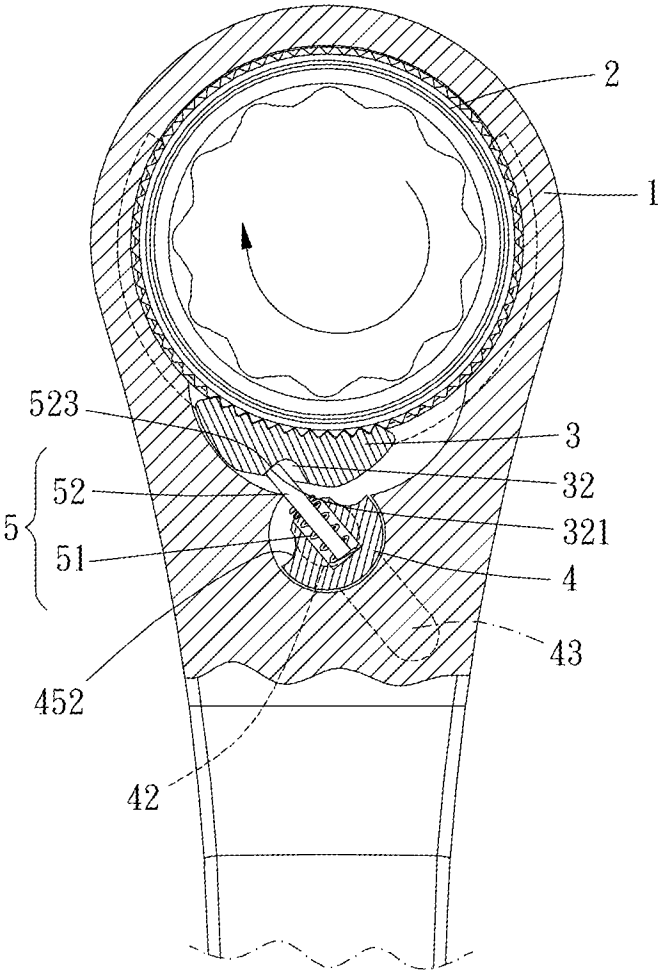
FIGS. 7 and 8 are operation diagrams of a preferable embodiment of the present invention.
Figure 7:
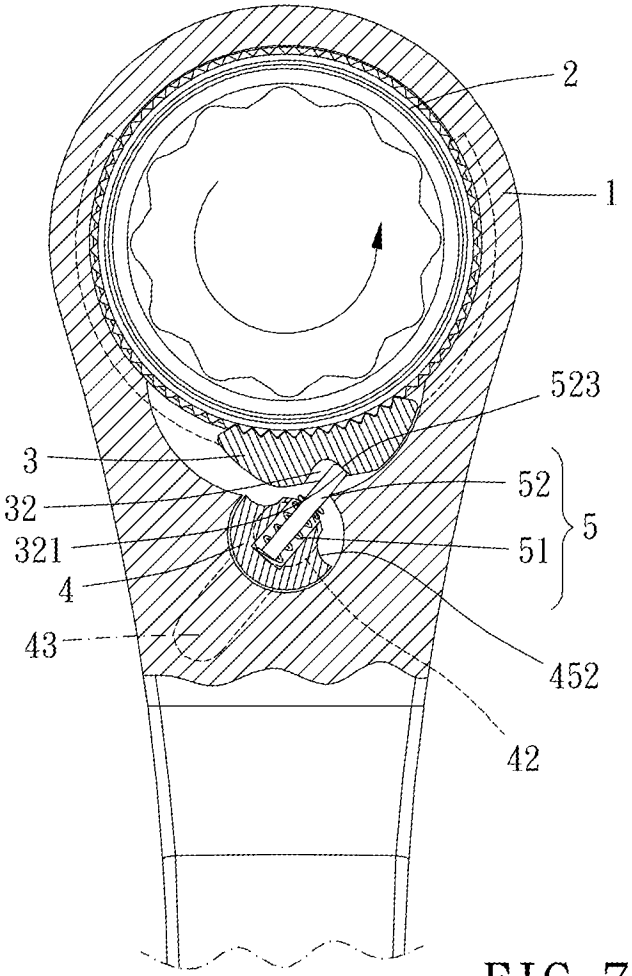

A position where the restricting member 3 and the first engaging portion 21 engage with each other is switchable by adjusting the switching member 4 so as to adjust the rotational direction of the driving member 2. In this embodiment, when the switching member 4 is switched to a first position, the restricting member 3 is biased by the elastic abutting assembly 5, and the restricting member 3 and the driving member 2 are restricted with each other in a first direction (indicated by an arrow direction shown in FIG. 7) so that the driving member 2 is non-rotatable in the first direction. As shown in FIG. 8, when the switching member 4 is switched to a second position, the restricting member 3 is biased by the elastic abutting assembly 5, and the restricting member 3 and the driving member 2 are restricted with each other in a second direction (indicated by an arrow direction shown in FIG. 8) so that the driving member 2 is non-rotatable in the second direction.

In this embodiment, the elastic abutting assembly 5 includes an elastic member 51 and an abutting block 52. The elastic member 51 is sleeved on the abutting block 52 and received within the receiving hole 44. Specifically, the abutting block 52 is E-shaped. The abutting block 52 includes a sleeved leg 521 and two blocking arms 522 which are located at two sides of the sleeved leg 521 respectively. The elastic member 51 is sleeved on the sleeved leg 521 and the two blocking arms 522 are slidably received within the receiving hole 44 so that the abutting block 52 is slidable. The receiving hole 44 includes an enlarged portion 441 and two extending portions 442 between which the enlarged portion 441 is disposed. The two blocking arms 522 are located within the two extending portion 442 respectively, and the elastic member 51 and the sleeved leg 521 are located within the enlarged portion 441 so as to prevent the elastic member 51 from departing from the switching member 4.

An end of the restricting member 3 away from the first engaging portion 21 has a recession 32, and an end of the abutting block 52 away from the switching member 4 is abutted against an inner wall of the recession 32 so as to prevent the abutting block 52 from departing from the restricting member 3. The inner wall of the recession 32 includes two flat surfaces 321, the end of the abutting block 52 away from the switching member 4 includes a flat end surface 523 which is in surface contact with one of the two flat surfaces 321.

Specifically, the rotatable member 41 has a notched portion 45 radially facing toward the restricting member 3. The rotatable member 41 has a flange 46 correspondingly above the notched portion 45, and the notched portion 45 includes a protruding portion 451 and arcuate concave segments 452 located at two sides of the protruding portion 451. As viewed in an axial direction of the rotatable member 41, a diametric dimension of the flange 46 is larger than that of the protruding portion 45. The receiving hole 44 is disposed at the protruding portion 451. When the switching member 4 is rotated, the flange 46 serves as an upper supporting portion and the projection 42 serves as an lower supporting portion to support two ends of the switching member 4, respectively, so as to obviate acting force of switching and prevent the switching member 4 from departing from the second receiving chamber 12, and the switching member 4 is smoothly rotatable. As viewed in the axial direction of the rotatable member 41, each of the arcuate concave segments 452 is tangent to the projection 42.

In summary, the rotatable member is rotatable smoothly with the projection as an axial. A first stepped portion is formed between the larger diameter section and the small diameter section, and a second stepped portion is formed between the rotatable member and the projection. The first stepped portion and the second stepped portion are abutted against each other so that the rotatable member is positioned stably on the larger diameter section to increase durability and efficiency of the ratchet wrench.

When the switching member is rotated, the flange forms an upper supporting portion and the projection forms a lower supporting portion to support two ends of the switching member so as to resist rotating force and prevent the switching member from departing from the second receiving chamber, and the switching member is rotatable smoothly.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A ratchet wrench, including:

a main body, has a first receiving chamber, a second receiving chamber being parallel to the first receiving chamber, and a third receiving chamber which is communicated with the first receiving chamber and the second receiving chamber, one end of the second receiving chamber including a larger diameter section, and another end of the second receiving chamber including a small diameter section;

a driving member, being rotatably assembled within the first receiving chamber, and a first engaging portion being disposed around a peripheral surface of the driving member;

a restricting member, being disposed in the third receiving chamber and having a second engaging portion which is engageable with the first engaging portion and configured to limit a rotational direction of the driving member;

a switching member, being rotatably disposed within the second receiving chamber, including a rotatable member and a projection which extends from the rotatable member, the rotatable member being received in the larger diameter section, the projection being received in the small diameter section, an end of the rotatable member away from the projection having a turning member extending radially, the rotatable member having a receiving hole radially recessed thereon;

an elastic abutting assembly, one end of the elastic abutting assembly being received within the receiving hole of the rotatable member, and another end of the elastic abutting assembly being restrictedly abutted against the restricting member and biasing the restricting member toward the first engaging portion;

wherein a position where the restricting member and the first engaging portion engage with each other is switchable by adjusting the switching member so as to adjust the rotational direction of the driving member;

wherein the elastic abutting assembly includes an elastic member and an abutting block, and the elastic member is sleeved on the abutting block and received within the receiving hole;

wherein an end of the restricting member away from the first engaging portion has a recession, and an end of the abutting block away from the switching member is abutted against an inner wall of the recession;

wherein the inner wall of the recession includes two flat surfaces, the end of the abutting block away from the switching member includes a flat end surface which is in surface contact with one of the two flat surfaces.

2. The ratchet wrench of claim 1, wherein the abutting block is E-shaped, the abutting block further includes a sleeved leg and two blocking arms which are located at two sides of the sleeved leg respectively, the elastic member is sleeved on the sleeved leg, and the two blocking arms are slidably received within the receiving hole.

3. The ratchet wrench of claim 2, wherein the receiving hole includes an enlarged portion and two extending portions between which the enlarged portion is disposed, the two blocking arms are located within the two extending portion respectively, and the elastic member and the sleeved leg are located within the enlarged portion.

4. The ratchet wrench of claim 3, wherein the rotatable member has a notched portion radially facing toward the restricting member, the rotatable member has a flange correspondingly above the notched portion, the notched portion includes a protruding portion and arcuate concave segments located at two sides of the protruding portion, and the receiving hole is disposed at the protruding portion; as viewed in an axial direction of the rotatable member, a diametric dimension of the flange is larger than that of the protruding portion; a first stepped portion is formed between the larger diameter section and the small diameter section, a second stepped portion is formed between the rotatable member and the projection, and the first stepped portion and the second stepped portion are abutted against each other.

5. The ratchet wrench of claim 1, wherein the rotatable member has a notched portion radially facing toward the restricting member, the rotatable member has a flange correspondingly above the notched portion, the notched portion includes a protruding portion and arcuate concave segments located at two sides of the protruding portion, and the receiving hole is disposed at the protruding portion; as viewed in an axial direction of the rotatable member, each of the arcuate concave segments is tangent to the projection.

6. The ratchet wrench of claim 5, wherein as viewed in the axial direction of the rotatable member, a diametric dimension of the flange is larger than that of the protruding portion.

7. The ratchet wrench of claim 1, wherein a first stepped portion is formed between the larger diameter section and the small diameter section, a second stepped portion is formed between the rotatable member and the projection, and the first stepped portion and the second stepped portion are abutted against each other.

* * * * *